US006314309B1

(12) United States Patent
Abdelmonem

(10) Patent No.: US 6,314,309 B1
(45) **Date of Patent: *Nov. 6, 2001**

(54) DUAL OPERATION MODE ALL TEMPERATURE FILTER USING SUPERCONDUCTING RESONATORS

(75) Inventor: Amr Abdelmonem, Arlington Heights, IL (US)

(73) Assignee: Illinois Superconductor Corp., Mt. Prospect, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/158,631

(22) Filed: Sep. 22, 1998

(51) Int. Cl.[7] ..... H01P 1/201

(52) U.S. Cl. ..... 505/210; 505/866; 333/202; 333/995

(58) Field of Search ..... 333/202, 995; 505/210, 700, 701, 866

(56) References Cited

U.S. PATENT DOCUMENTS

| | | | |
|---|---|---|---|
| 3,737,799 | 6/1973 | Ständer | 330/126 |
| 3,911,366 | 10/1975 | Baghdady . | |
| 3,988,679 | 10/1976 | Clarke et al. . | |
| 4,476,575 | 10/1984 | Franke et al. | 455/76 |
| 4,609,892 | 9/1986 | Higgins, Jr. | 333/204 |
| 4,668,920 | 5/1987 | Jones | 330/286 |
| 4,679,248 | 7/1987 | McKeown | 455/226 |
| 4,733,403 | 3/1988 | Simone . | |
| 4,742,561 | 5/1988 | Tipton | 455/67 |
| 4,903,257 | 2/1990 | Takeda et al. . | |
| 4,907,291 | 3/1990 | Yamamoto | 455/78 |
| 4,922,509 | 5/1990 | Tresset et al. . | |
| 4,972,455 | 11/1990 | Phillips et al. | 379/59 |
| 5,020,148 | 5/1991 | Bonato | 455/302 |
| 5,083,236 | 1/1992 | Chason et al. . | |
| 5,157,364 | 10/1992 | Pond et al. | 333/203 |
| 5,222,144 | 6/1993 | Whikehart | 381/15 |
| 5,244,869 | 9/1993 | Billing . | |
| 5,324,713 | 6/1994 | Shen | 505/210 |
| 5,339,459 | 8/1994 | Schiltz et al. | 455/333 |
| 5,355,524 | 10/1994 | Higgins, Jr. | 455/82 |
| 5,357,544 | 10/1994 | Horner et al. . | |
| 5,412,339 | 5/1995 | Takano | 330/54 |
| 5,490,173 | 2/1996 | Whikehart et al. | 375/316 |
| 5,493,581 | 2/1996 | Young et al. | 375/350 |
| 5,537,680 | 7/1996 | Bruno | 455/15 |
| 5,616,540 | 4/1997 | Lithgow et al. | 505/210 |
| 5,629,266 | 5/1997 | Lithgow et al. | 505/210 |
| 5,640,698 | 6/1997 | Shen et al. | 455/323 |
| 5,697,087 | 12/1997 | Miya et al. | 455/307 |
| 5,789,347 | 8/1998 | Button et al. | 505/450 |
| 5,804,534 * | 9/1998 | Zaki | 333/99 S |

FOREIGN PATENT DOCUMENTS

| | | | |
|---|---|---|---|
| 2235828 * | 3/1991 | (GB) | 505/866 |
| 10224110 | 8/1998 | (JP) . | |
| 10224269 | 8/1998 | (JP) . | |
| WO 96/42118 | 12/1996 | (WO) . | |

OTHER PUBLICATIONS

Horowitz, et al., *The Art of Electronics*, Cambridge University Press, 2d ed., pp. 35–42, 263–272 (1989).

* cited by examiner

*Primary Examiner*—Justin P. Bettendorf
(74) *Attorney, Agent, or Firm*—Marshall, Gerstein & Borun

(57) ABSTRACT

A dual operation mode all temperature filter is provided. The dual operation mode filter is provided with a housing defining at least two cavities, an input port and an output port. It is also provided with a non-superconducting resonator disposed in a first one of the cavities and a superconducting resonator disposed in a second one of the cavities. The second resonator comprises a superconducting material containing 8–15% silver. The dual operation mode filter filters at a relatively high level at temperatures below a threshold temperature and at a lower, conventional level, at temperatures below the threshold.

7 Claims, 4 Drawing Sheets

DUAL OPERATION MODE ALL TEMPERATURE FILTER USING SUPERCONDUCTING RESONATORS

FIELD OF THE INVENTION

The invention relates generally to filters, and, more particularly, to a dual operation mode all temperature filter using superconducting resonators.

BACKGROUND OF THE INVENTION

Radio Frequency (RF) filters have been used with cellular base stations and other telecommunications equipment for some time. Such filters are conventionally used to filter out noise and other unwanted signals. For example, bandpass filters are conventionally used to filter out or block radio frequency signals in all but one or more predefined band(s). By way of another example, notch filters are conventionally used to block signals in a predefined radio frequency band.

The relatively recent advancements in superconducting technology have given rise to a new type of RF filter, namely, the high temperature superconducting (HTSC) filter. HISC filters contain components which are superconductors at or above the liquid nitrogen temperature of 77 K. Such filters provide greatly enhanced performance in terms of both sensitivity (the ability to select signals) and selectability (the ability to distinguish desired signals from undesirable noise and other traffic) as compared to conventional filters. However, since known high temperature superconducting (HTSC) materials are only superconductive at relatively low temperatures (e.g., approximately 90 K or lower), and are relatively poor conductors at ambient temperatures, such superconducting filters require accompanying cooling systems to ensure the filters are maintained at the proper temperature during use. As a result, the reliability of traditional superconducting filters has been tied to the reliability of the power source. Specifically, if the power source (e.g., a commercial power distribution system) fails (e.g., a black out, a brown out, etc.) for any substantial length of time, the cooling system would likewise fail and, when the corresponding superconducting filters warm sufficiently to prevent superconducting, so too would the filters.

To prevent systems serviced by such filters from failing during these power outages, additional circuitry in the form of RF bypass circuitry was often needed to switch out the failed filter until a suitably cooled environment was returned. Such bypass circuitry added expense and complexity to known systems.

SUMMARY OF THE INVENTION

In accordance with an aspect of the invention, a filter is provided. The filter includes a housing defining at least two cavities, an input port, and an output port. It also includes a first non-superconducting resonator disposed in a first one of the cavities; and a first superconducting, resonator disposed in a second one of the cavities.

Preferably, the superconducting resonator comprises a superconducting material including 8–15% silver by weight.

In some embodiments, the filter is further provided with a second superconducting resonator disposed in a third cavity and a second non-superconducting resonator disposed in a fourth cavity. In such embodiments, the first cavity may optionally define an input cavity and the fourth cavity may optionally define an output cavity.

In accordance with another aspect of the invention, a combination comprising a dual operation mode filter and a conventional filter cascaded with the dual operation mode filter is provided. The dual operation mode filter provides a first level of filtering at temperatures below a threshold temperature and a second level of filtering at temperatures above the threshold temperature. The first level is higher than the second level.

In some embodiments, a low noise amplifier is coupled between the dual operation mode filter and the conventional filter. In other embodiments, an isolator is coupled between the dual operation mode filter and the conventional filter.

In some embodiments, the dual operation mode filter comprises a bandpass filter.

Other features and advantages are inherent in the apparatus claimed and disclosed or will become apparent to those skilled in the art from the following detailed description and its accompanying drawings.

DESCRIPTION OF THE PREFERRED EMBODIMENTS

Figure 1:
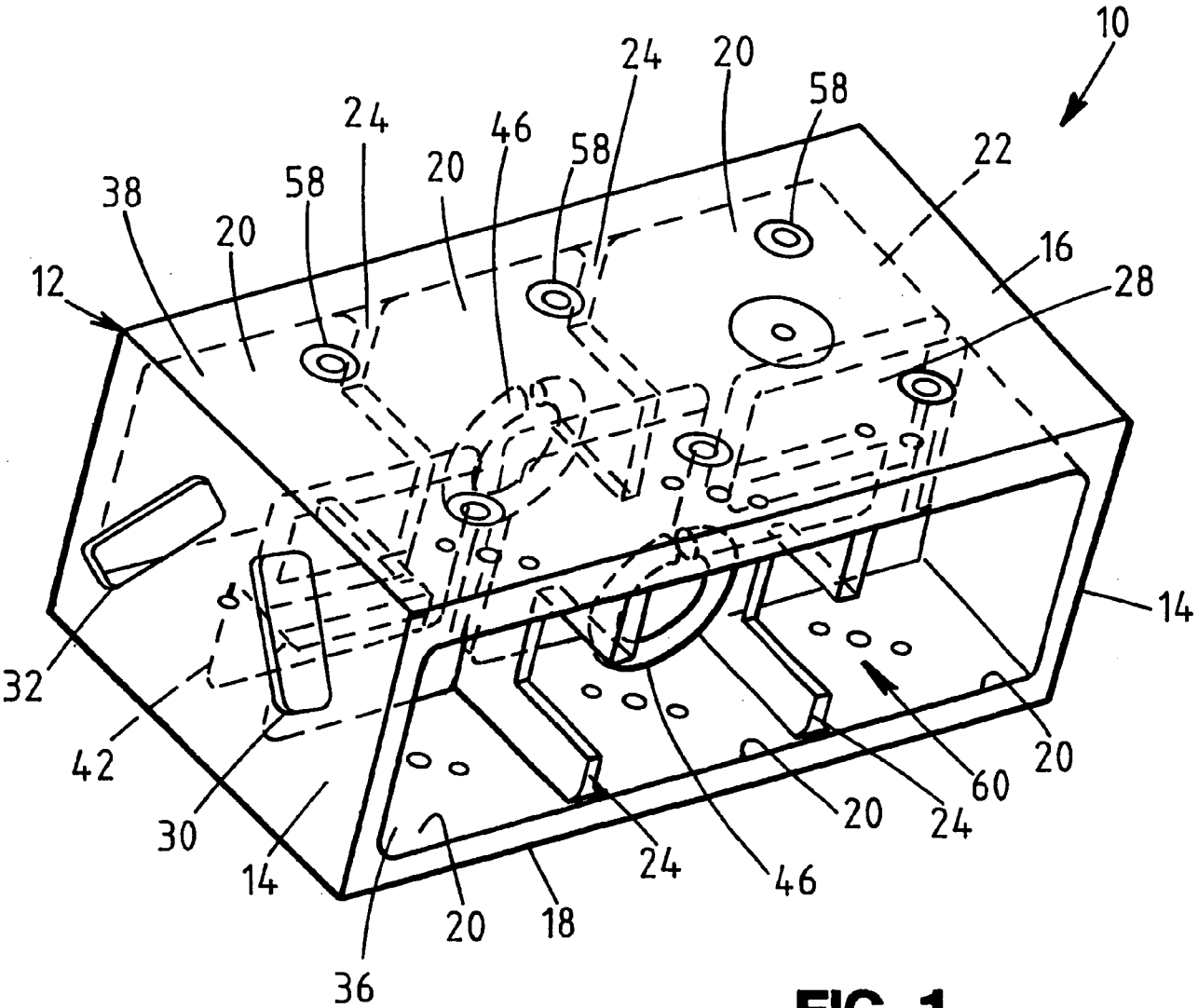
FIG. 1 is a schematic illustration of a dual operation mode all temperature filter constructed in accordance with the teachings of the instant invention.

A dual operation mode all temperature filter 10 constructed in accordance with the teachings of the invention is shown in FIG. 1. As discussed below, the filter 10 provides a first level of filtering when its temperature is maintained at a temperature below a threshold temperature, and a second level of filtering which is less than the first level when its temperature exceeds the threshold value. More specifically, when maintained in a cooled environment, the filter 10 produces the enhanced level (high rejection and low insertion loss) of filtering expected of HTSC filters, but when exposed to a non-cooled environment (e.g., due to a failure in the cooling system), the filter 10 delivers filtering at a level (high rejection with some insertion loss) expected of conventional (non-HTSC) RF filters. Thus, the disclosed filter 10 provides enhanced performance as compared to conventional filters and enhanced reliability as compared to prior art HTSC filters. Specifically, it provides enhanced filtering levels in most instances and ensures acceptable levels of filtering are maintained in adverse circumstances such as during power interruptions.

Although the disclosed filter 10 is particularly well suited for use with wireless telecommunication systems and will be discussed in that context herein, persons of ordinary skill in the art will readily appreciate that the teachings of the invention are in no way limited to such an environment of use. On the contrary, filters constructed pursuant to the teachings of the invention can be employed in any application which would benefit from the high performance filtering and enhanced reliability it provides without departing from the scope or spirit of the invention.

Figure 2:
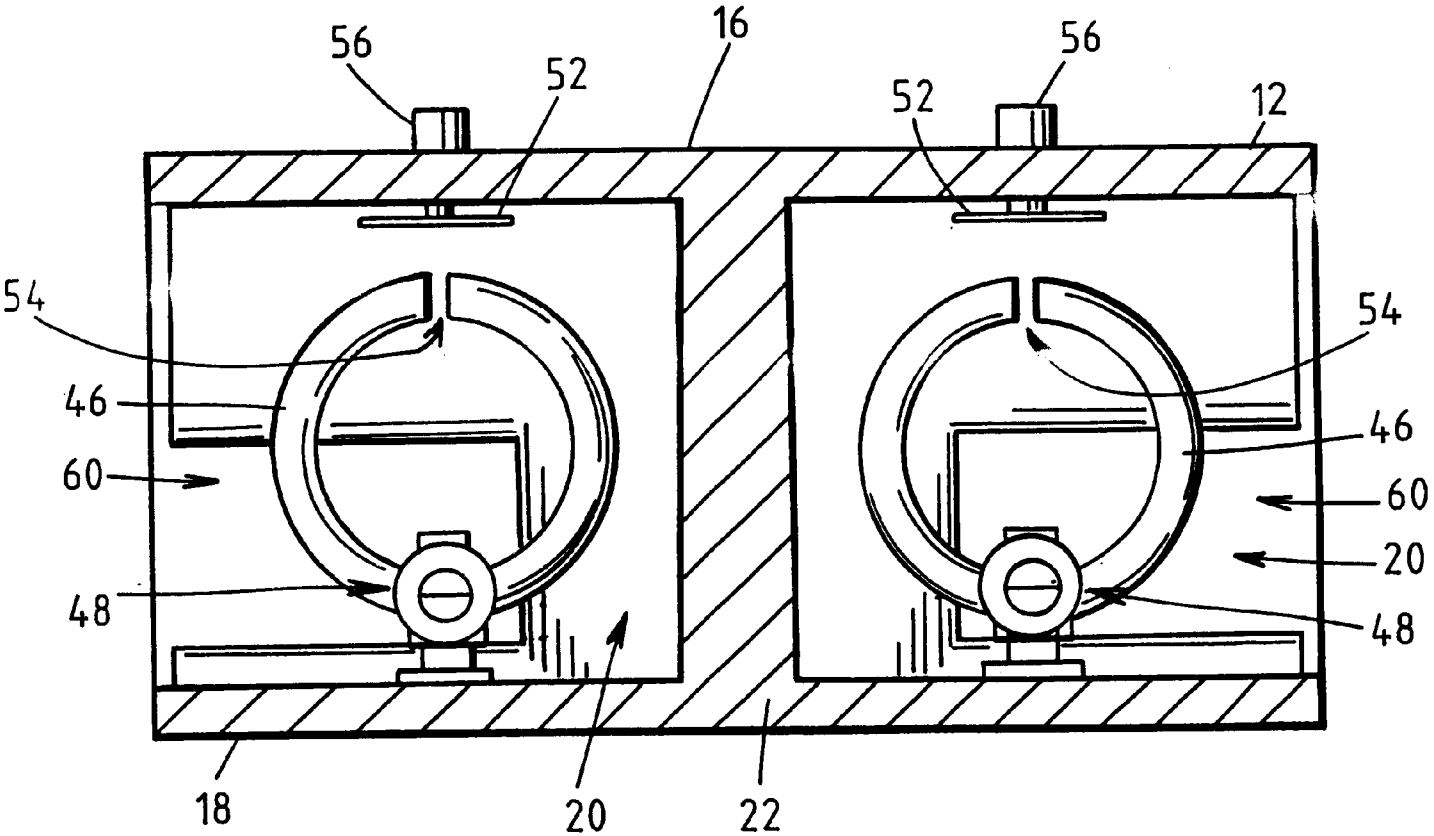
FIG. 2 is a cross-sectional view of the filter of FIG. 1.

For the purpose of defining a chamber to contain, direct and filter electromagnetic signals, the filter 10 is provided with a housing 12 (see FIGS. 1 and 2). As shown in FIG. 1, the housing 12 includes a pair of end walls 14, an upper wall 16, a lower wall 18, and a pair of side plates (not shown)

secured via conventional fasteners such as screws or the like to the end wall 14, the upper wall 16, and/or the lower wall 18.

To divide the housing chamber into a plurality of resonant cavities 20, the housing 12 is further provided with an inner partition wall 22 (see FIGS. 1 and 2) and a plurality of inner walls 24. As shown in FIG. 1, the inner partition wall 22 and the inner walls 24 together define two parallel rows of resonant cavities 20. To couple the rows of cavities 20, the inner partition wall 22 defines a coupling aperture 28.

In order to input electromagnetic signals into the housing 12 and to retrieve filtered signals from the housing 12, an end wall 14 of the housing 12 respectively defines an input aperture 30 and an output aperture 32. As shown in FIG. 1, the input and output apertures 30, 32 are defined at an end of the housing 12 opposite the coupling aperture 28. Thus, an electromagnetic signal delivered to the filter 10 via the input aperture 30 will travel down the first row of resonant cavities 20, pass through the coupling aperture 28, and return up the second row of resonant cavities 20 and out the output port 32.

The thickness of the inner partition wall 22 is preferably selected to accommodate the requirements of the coupling mechanism employed to deliver electromagnetic signals to the filter 10. The two resonant cavities 20 located adjacent the end wall defining the input and output apertures 30, 32 form an input cavity 36 and an output cavity 38 which respectively receive at least a portion of a conventional input coupling mechanism and a conventional output coupling mechanism (not shown). In the disclosed embodiment, the input and output cavities 36, 38 are separated by a thickened section 42 of the inner partition wall 22. This thickened section 42 has approximately twice the thickness of the remainder of the inner partition wall 22. As will be appreciated by persons of ordinary skill in the art, the precise dimensions of the thickened section 42 of the inner partition wall 22 are selected based upon the frequency and loading conditions the filter 10 is expected to accommodate.

As is conventional, the input and output coupling mechanisms are connected to respective RF transmission lines (not shown) that carry RF signals to and from the filter 10. In general, each coupling mechanism includes an antenna (not shown) for propagating (or collecting) electromagnetic waves within the input and output cavities 36 and 38. The antenna may include a simple conductive loop or a more complex structure that provides for mechanical adjustment of the position of a conductive element within the cavity 36, 38. An example of such a coupling mechanism is described in U.S. Pat. No. 5,731,269, the disclosure of which is hereby incorporated in its entirety by reference.

For the purpose of tuning each cavity 20 to remove an undesirable frequency or range of frequencies from the RF signal being processed, each resonant cavity 20 is provided with a resonator 46. (For simplicity of illustration, only two resonators 46 are shown in FIG. 1.) Although persons of ordinary skill in the art will readily appreciate that resonators of various types can be employed in this role without departing from the scope or the spirit of the invention, in the preferred embodiment, the resonators 46 are each preferably implemented as a split-ring, toroidal resonator 46. The resonators 46 are each located within their respective resonant cavity 20 as shown in FIGS. 1 and 2. Each resonator is individually adjustable within its respective cavity. By selecting its orientation, the degree and type of coupling between each resonator 46 and the electromagnetic signals in its cavity can be adjusted as is known to those skilled in the art. Each resonator 46 is secured to the lower wall 18 by a dielectric mounting mechanism generally indicated at 48 in FIG. 2. The mounting mechanism 48 is secured to the lower wall 18 via conventional fasteners (not shown) such as screws or the like that extend through apertures (not shown) defined in the wall 18. Further details on exemplary mounting mechanisms may be found in U.S. Pat. No. 5,843,871, the disclosure of which is hereby incorporated in its entirety by reference. Another suitable dielectric mounting mechanism is described and shown in U.S. patent application Ser. No. 08/869,399now U.S. Pat. No. 5,889,448, the disclosure of which is also hereby incorporated in its entirety by reference.

For the purpose of individually tuning the cavities, each cavity is provided with a tuning disk 52 (FIG. 2). The tuning disks 52 are the primary mechanism for tuning the resonant cavities 20. As most easily seen in FIG. 2, each tuning disk 52 projects into its associated resonant cavity 20 near a gap 54 (best seen in FIG. 2) in the resonator 46. Preferably, each tuning disk 52 is coupled to a screw assembly 56 (FIG. 2) that extends through an aperture 58 (FIG. 1) defined in the upper wall 16. Such a mechanism for tuning split-ring resonators is well known to those skilled in the art and will not be further described herein. Further details, however, may be found in the disclosure of U.S. Pat. No. 5,843,871, which is hereby incorporated in its entirety by reference.

For the purpose of facilitating transmission of electromagnetic signals between respective pairs of the resonant cavities 20, the inner walls 32 disposed between adjacent coupled resonant cavities 20 of the RF filter 10 define coupling apertures 60 (see FIGS. 1 and 2). The size and shape of the individual coupling apertures 60 may vary greatly, as will be appreciated by those skilled in the art. For instance, as shown in FIG. 2, the coupling apertures 60 are generally rectangular. In contrast, other adjacent resonant cavities 20 are coupled together by larger and/or differently shaped apertures (e.g., T-shaped apertures).

In order to further tune the RF filter 10 and to thereby establish a particular response curve for the device, adjustment of the coupling between adjacent resonant cavities 20 can be further effected via coupling screws (not shown) disposed in bores (also not shown) in the upper wall 28, as is conventional. The bores are preferably positioned such that each coupling screw projects into a respective coupling aperture 60.

The housing 12 of the RF filter 10 is preferably made of silver-coated aluminum, but may be made of a variety of materials having a low resistivity.

In accordance with an aspect of the invention, at least one, but not all, of the resonators 46 is made from a high temperature superconducting (HTSC) material which is doped with 8–15% silver. This high level of silver doping (conventional levels are on the order of 1–2%) enables the HTSC material to maintain a reasonable level of conductivity at temperatures above the superconducting threshold (i.e., to have a reasonably high Q factor at normal ambient temperatures).

At least one of the resonators 46 in the filter 10 is not made from an HTSC material. Instead, these resonators are made of a conventional conductive material such as copper. The copper resonator(s), therefore, exhibit conventional levels of conductivity at higher environmental temperatures such as room temperature.

Figure 3:
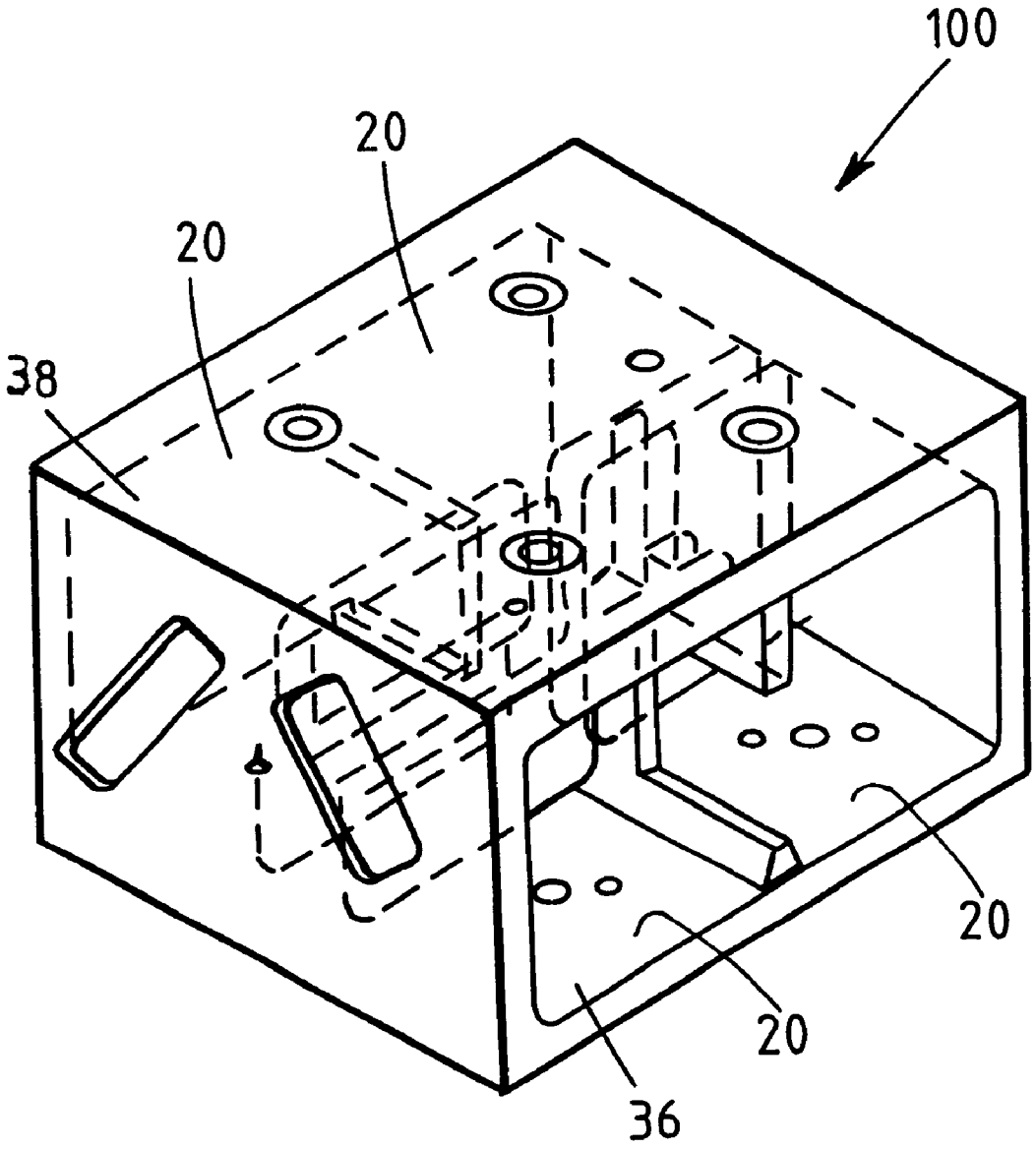
FIG. 3 is a schematic illustration of a second dual operation mode all temperature filter constructed in accordance with the teachings of the invention.

More specifically, in a preferred embodiment shown in FIG. 3, a four pole filter 100 comprising four resonant cavities 20, and four resonators 46 (see FIG. 1) is provided.

In the disclosed embodiment, the resonators 46 in the input and output cavities 36, 38 are implemented as copper toroids with no high temperature superconducting properties. The remaining two resonators 46 are also toroids. However, these last two resonators 46 are made out of an HTSC material doped with approximately 10% silver. As a result, when the filter 100 is cooled below a superconducting threshold temperature (typically to approximately 77K), the superconducting toroids 46 will exhibit their superconducting properties and the filter 100 will enjoy the enhanced filtering associated with HTSC filters. In the event of a failure in the cooling system (e.g., a power failure), the filter 100 will continue operating at the enhanced filtering level for some dwell time (typically on the order of several hours) until the filter 100 warms above the superconducting threshold. Once such warming has occurred, the high silver doping of the HTSC resonators 46 ensures that the HTSC resonators 46 will still conduct at conventional levels (i.e., not at superconducting levels). As a result of this property of the HTSC resonators 46 and as a result of the presence of the conventional (non-HTSC) resonators 46, the filter 100 automatically switches to a conventional filtering mode of operation wherein the filter 100 filters signals as if it were a conventional (i.e., non-superconducting) filter. Upon returning to the super cooled state (e.g., upon resumption of power to the cooling system), the filter 100 automatically switches into its ultra-high performance mode where it performs filtering at the enhanced level typical of HTSC filters. Filters constructed in accordance with the teachings of the invention exhibit very low insertion loss. For example, the four pole filter 100 shown in FIG. 3 exhibited an insertion loss of 2–5 dB at room temperature and an insertion loss of 0.2 dB at 77 K.

As will be appreciated by persons of ordinary skill in the art, the ability of the dual operation mode filters 10, 100 to automatically switch between operating modes renders the filters 100 operational at all temperatures, thereby removing the need for the RF bypass circuitry and/or temperature control circuitry associated with prior art HTSC filters. The elimination of this circuitry reduces the size and cost of the filters 100. The filter 100 is, thus, less expensive, more reliable and smaller than conventional HTSC filters.

A process for manufacturing RTSC resonators 46 is disclosed in U.S. Pat. No. 5,789,347, which issued on Aug. 4, 1998 and which is hereby incorporated in its entirety by reference. The '347 Patent, however, discloses the use of 2% by weight of silver powder in the HTSC material. The HTSC resonators 46 used in filters constructed in accordance with the present invention can be manufactured pursuant to the process disclosed in the '347 Patent with silver doping levels increased to 8–15% by weight. Although silver doping in the range of 8–15% is presently believed to be acceptable, at the present time doping at approximately a 10% level by weight is preferred. In addition, although the HTSC resonators described above can be made of heavily silver doped HTSC material, persons of ordinary skill in the art will appreciate that other approaches can be taken without departing from the scope or spirit of the invention. For example, the HTSC resonators 46 can be made of stainless steel toroids coated with HTSC material which is heavily silver doped in accordance with the ranges specified above without departing from the teachings of the invention.

Persons of ordinary skill in the art will readily appreciate that, although the preferred embodiment uses high silver doping to increase the ambient temperature conductivity of its HTSC resonators 46, other conductive doping materials can be used in this role without departing from the scope or spirit of the invention. Persons of ordinary skill in the art will further appreciate that although the filters disclosed herein are low order filters having six or fewer poles, filters with other numbers of poles can be constructed in accordance with the teachings of the invention. However, filters with four to six poles are presently preferred.

The filters 10, 100 shown in FIGS. 1 and 3 are bandpass filters (i.e., filters designed to pass frequencies in a predetermined range and to block signals in frequencies higher and lower than that range). However, persons of ordinary skill in the art will appreciate that the teachings of the invention are not limited to such filters. For example, a notch filter (i.e., a filter designed to block frequencies in a predetermined range) can be constructed pursuant to the teachings of the invention. Unlike the bandpass filters 10, 100 described above, such notch filters employ HTSC resonators 46 whose HTSC material is not doped (in order to completely decouple at room temperature). Also like the bandpass filters 10, 100 described above, the notch filters filers at an enhanced level typical of HTSC filters when maintained at a temperature at or below the superconducting threshold. However, when the notch filter is warmed above the threshold level, it acts as a pass through filter within the predetermined range (i.e., it stops blocking signals in the predetermined range). As a result, if the cooling system associated with the notch filter fails, the notch filter will permit signals having frequencies in the predetermined range to pass through without impediment, and, thus, will not prevent the serviced telecommunication device (e.g., a base station) from operating. The notch filter achieves this result because, at ambient temperatures, the notch range will shift to a different range. Accordingly, at ambient temperatures a different range of frequencies will be blocked than at superconducting temperatures. The filter designer should consider this shift to ensure that desirable signals are not blocked at ambient temperatures.

An exemplary HTSC notch filters is disclosed in U.S. Pat. No. 5,843,871, which is hereby incorporated in its entirety by reference. The notch filters described in this document is constructed like the notch filters described in the above-referenced '871 patent but with the resonator modifications described above (and preferably limited to 6 or fewer poles). Accordingly, the interested reader is referred to the above-referenced '871 patent for a detailed discussion of the implementation details of HTSC notch filters.

Figure 4:
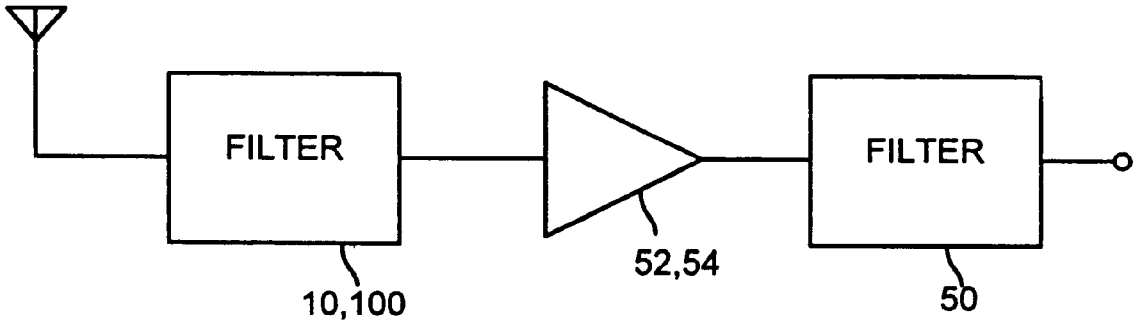
FIG. 4 is a schematic illustration of a circuit employing the dual operation mode filter.

In order to enhance the filtering performance of the dual operation mode filters 10, 100, the dual operation mode filters (bandpass or notch) 10, 100, may be cascaded with one or more conventional filters 50 as shown in FIG. 4. By using cascaded filters 50, it is possible to achieve high performance filtering typically associated with high order filters while using only low order pole filters. A detailed discussion of the virtues of cascading filters is provided in co-pending U.S. patent application Ser. No. 09/130,274, filed Aug. 6, 1998, which is hereby incorporated in its entirety by reference.

As shown in FIG. 4, the conventional filter 50 is preferably connected to the dual operation mode filters 10, 100, via either a low noise amplifier 52 or an isolator 54. A low noise amplifier 52 would be used in applications where it is desirable to amplify the filtered signal output by the dual operation mode filters 10, 100, prior to filtering by the conventional filter 50. The isolator 54 would be used in applications where low loss transmission between the filter 10, 100, and 50 is desired, but where it is undesirable to permit operation of the conventional filter 50 to effect the operation of the dual operation mode filter 10, 100. A cascaded filter implemented with a dual operation mode, 4 pole bandpass filter 100, an isolator 54, and a conventional, high rejection filter 50, experienced increased insertion loss as compared to the statistics quoted above, but was tuned while achieving more than 20 dB/1 MHz rejection.

Persons of ordinary skill in the art will appreciate that the RF spectrum is divided into A, B, A' and B' bands. The B band separates the A and A' bands. The A' band separates the B and B' bands. Such persons will further appreciate that it is often desirable to broadcast in the A and A' bands without broadcasting in the B band and/or to broadcast in the B and B' bands without broadcasting in the A' band. Prior art systems solved this K problem by using two bandpass filters in parallel and multiplexing the outputs of the parallel filters.

By using a bandpass filters (either conventional or dual operation mode) cascaded with a notch filters (either conventional or dual operation mode), the same result can be achieved without requiring multiplexing. For ad example, if the bandpass filters is designed to pass signals in the A, B and A' bands and the notch filter blocks signals in the B band, an A, A' band filter is achieved. Alternatively, if the bandpass filter is designed to pass signals in the B, A' and B' bands and the notch filter is designed to block signals in the A' band, a B, B' band filters is achieved.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. A filter comprising:

a housing defining at least two cavities;

a first non-superconducting resonator disposed in a first one of the at least two cavities; and a first superconducting resonator disposed in a second one of the at least two cavities;

wherein the first superconducting resonator is conductive at temperatures above a critical temperature for high-temperature superconduction.

2. A filters as defined in claim 1 wherein the first superconducting resonator comprises a superconducting material including 8–15% silver by weight.

3. A filters as defined in claim 1 further comprising a second non-superconducting resonator and a second superconducting resonator wherein:

the housing further defines a third cavity and a fourth cavity; and the second superconducting resonator and the second non-superconducting resonator are disposed in the third cavity and the fourth cavity, repectively.

4. A filter as defined in claim 3 wherein the first one of the at least two cavities defines an input cavity and the fourth cavity defines an output cavity.

5. A filters comprising:

a housing defining a first cavity and a second cavity;

a non-superconducting resonator disposed in the first cavity; and a superconducting resonator disposed in the second cavity and comprising a thick-film wherein the thick film includes a high-temperature superconducting material wherein the thick film of high-temperature superconducting material is doped with a conventional conductive material to maintain non-superconductive conduction at a temperature above a critical temperature for the high-temperature superconducting material.

6. A filters as defined in claim 5 wherein the thick film comprises 8–15% silver by weight.

7. A resonator comprising:

a resonant element having a high-temperature superconducting material wherein the high-temperature superconducting material comprises a conventional conductive material to maintain non-superconductive conduction at a temperature above a critical temperature for the high-temperature superconducting material, and the conventional conductive material amounts to more than 8–15% by weight of the high-temperature superconducting material.

* * * * *